United States Patent [19]

Greten

[11] 4,139,308

[45] Feb. 13, 1979

[54] GLUING MACHINE FOR GLUING LIGNOCELLULOSE-CONTAINING PARTICLES USED FOR PRODUCING PRESSED WOOD PLATES

[75] Inventor: Berndt Greten, Springe, Fed. Rep. of Germany

[73] Assignee: bison-werke Bähre & Greten GmbH & Co. KG, Springe, Fed. Rep. of Germany

[21] Appl. No.: 861,539

[22] Filed: Dec. 19, 1977

[30] Foreign Application Priority Data

Dec. 22, 1976 [DE] Fed. Rep. of Germany ..... 2658243

[51] Int. Cl.[2] ..... B01F 7/04; B01F 15/02

[52] U.S. Cl. ..... 366/147; 366/169; 366/329; 366/327

[58] Field of Search ..... 366/147, 168, 169, 144, 366/170, 173, 325, 327, 329

[56] References Cited

U.S. PATENT DOCUMENTS

| | | | |
|---|---|---|---|
| 3,762,947 | 10/1973 | Ornstein | 366/147 |
| 3,845,940 | 11/1974 | Lodige | 366/147 |
| 3,856,271 | 12/1974 | Lodige | 366/147 |
| 4,006,706 | 2/1977 | Lodige | 366/169 |
| 4,006,887 | 2/1977 | Engels | 366/169 |
| 4,015,830 | 4/1977 | Lodige | 366/169 |

*Primary Examiner*—Robert W. Jenkins
*Attorney, Agent, or Firm*—Max Fogiel

[57] ABSTRACT

A gluing machine for gluing lignocellulose-containing particles such as fibers, shavings, dust, and the like, for the production of pressed wood plates, in which a housing has, at one end, an intake for material to be glued. At the other end of the housing there is an outlet for glued material. A stirring mechanism having mixing tools rotating with a shaft, is centered in the housing. Glue supply nozzles are also provided. The mixing tools are in the form of rods which run parallel to the stirring mechanism shaft, and they are supported on their ends on this shaft. The rods carry spaced cross surfaces, and are relatively close to the housing interior wall. At least some of the cross surfaces are inclined relative to the longitudinal axes of the rod with either the stirring mechanism shaft inclined from the horizontal in the direction towards the outlet downward, or with the horizontal stirring mechanism shaft. The rods may be in the form of tubes, and the interiors of the tubes may be connected to the stirring mechanism shaft to form at least partially a hollow shaft to serve as conduits for cooling agents. The cross surfaces may be in the form of annular disks, and adjacent annular disks may be held inclined and spaced by tube sections having chamfered ends.

8 Claims, 4 Drawing Figures

Fig. 1
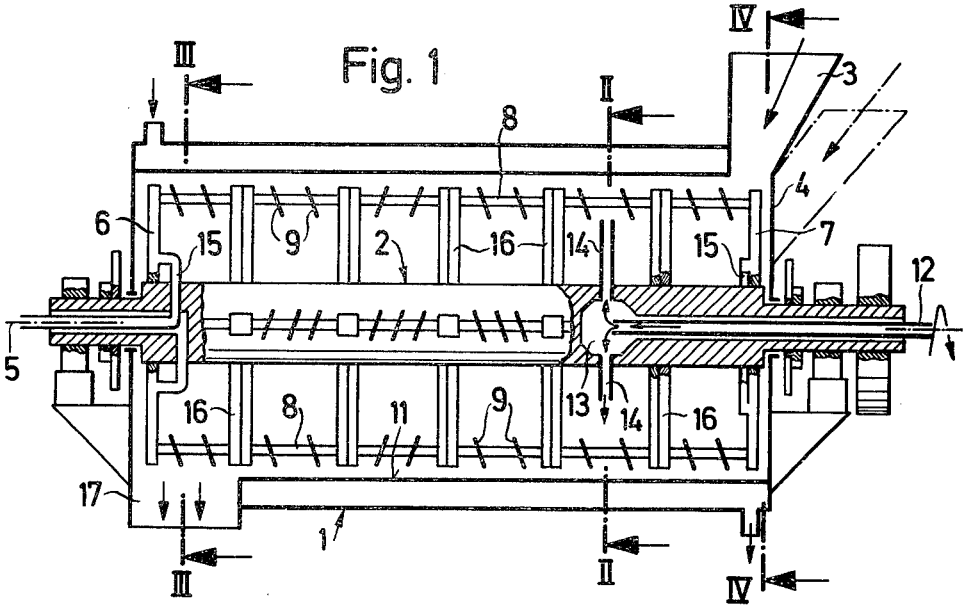
Fig. 2
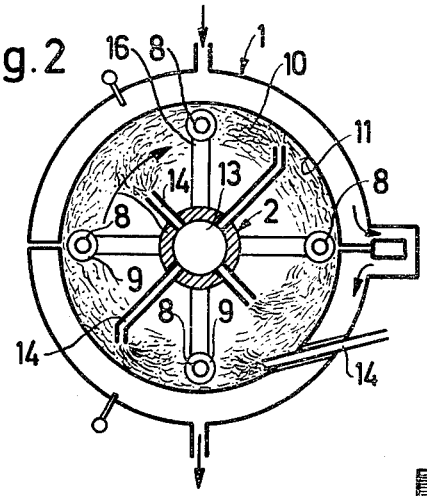
Fig. 3
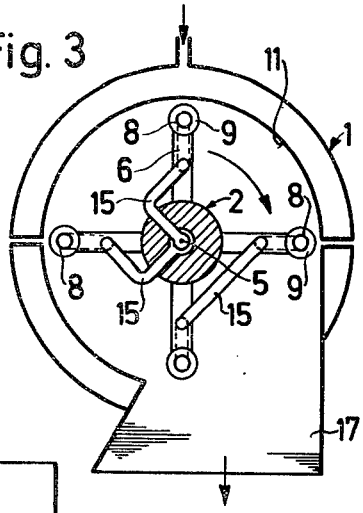
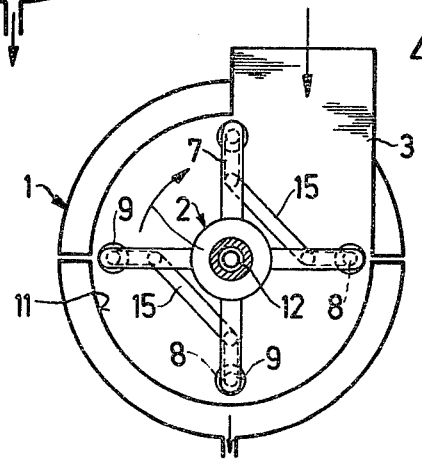
Fig. 4

GLUING MACHINE FOR GLUING LIGNOCELLULOSE-CONTAINING PARTICLES USED FOR PRODUCING PRESSED WOOD PLATES

BACKGROUND OF THE INVENTION

The present invention relates to a gluing machine for gluing lignocellulose-containing particles, such as fibers, shavings, dust, etc. for the production of pressed wood plates. A housing has, on one end, an intake for the material to be glued, and on the other end it has an outlet for glued material. A stirring mechanism is provided with mixing tools and it rotates with a centered on a shaft in a housing. Glue supply nozzles are also provided. Gluing machines of this type are known from the German Utility Pat. No. 7,112,402.

With the known gluing machine and even with other gluing machines, the mixing tools extend from the stirring mechanism shaft into the annular space in which the goods to be glued (bonded) are moved from the intake to the outlet. The binding agent to be delivered to the particles is partly supplied through lines passing through the jacket surface of the housing and partially by lines located in the stirring mechanism shaft and rotating with it. The position of the discharge openings of these lines is adjustable. The stirring mechanism shaft and thus the mixing tools revolve at relatively high speed. As a result, both the finer and coarser particles of the material to be bonded are provided with the binding agent quantities required to produce optimum quality chip board, etc.

It is an object of the present invention to improve upon these known gluing machines further so that the optimum gluing of the fractions achieved by the known gluing machines, is also maintained at lower speeds, but the dwell time of the material in the gluing machine can be reduced.

Another object of the present invention is to provide an improved gluing machine of the foregoing character, which is substantially simple in construction and may be economically fabricated.

A further object of the present invention is to provide a gluing machine, as described, which may be readily maintained in service and which has a substantially long operating life.

SUMMARY OF THE INVENTION

The objects of the present invention are achieved by providing that the mixing tools are rods which run parallel to the stirring mechanism shaft and are supported on their ends on the stirring mechanism shaft. These rods carry spaced cross surfaces and are relatively close to the housing inside wall, with either the stirring mechanism shaft being inclined from the horizontal in the direction to the outlet downward, or with horizontal stirring mechanism shaft there are at least some cross surfaces inclined relative to the lengthwise axes of the rods. Since the surface of the mixing tools is much greater than that of known mixing tools, one cannot only reduce the dwell time of the material in the gluing machine, but also reduce the required drive power of the stirring mechanism, without impairing the gluing ability.

While the mixing tools of the known gluing machines were, until now, moved over a circular track and space remained between adjacent mixing tools where the material to be bonded was not directly grasped by the mixing tools, the mixing tools now move on the shell surface of a hollow cylinder. Hence the mixing tools virtually represent the shell lines of such a hollow cylinder. Thus an extremely intensive mixing of the material to be bonded with the binding agent is achieved. The cross surfaces located on the rods act not only as mixing tools since they divide the mixing material ring temporarily into partial flows, but also as transport means for the material to be bonded, and already bonded, when they extend perpendicular to the rods and the stirring mechanism axis of rotation is inclined. If the cross surfaces are at least partially inclined relative to the rods, the axis of rotation of the stirring mechanism shaft can extend horizontally because the transport of the particles is effected by this inclined position of the cross surfaces. Through the inclined position of the cross surfaces, or the inclination of the axis of rotation of the stirring mechanism shaft, the dwell time can be adapted to the prevailing requirements without impairing the gluing quality.

It is expedient to have the rods made out of tubes since this reduces the bending of the mixing tools. If the rods are tubes, it is recommended that their interior spaces be connected to the stirring mechanism shaft, which is at least partially a hollow shaft. This provides a cooling agent line, which has the additional advantage that the cooling of the housing of the gluing machine can be possibly omitted because the relatively large surface of the mixing tools permit a better cooling of the material which heats up during the gluing.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 shows a lengthwise section through a gluing machine in accordance with the invention;

FIG. 2 shows a cross-section taken along line II—II in FIG. 1;

FIG. 3 shows a cross-section taken along line III—III in FIG. 1; and

FIG. 4 shows a cross-section taken along line IV—IV in FIG. 1.

DESCRIPTION OF THE PREFERRED EMBODIMENTS

A hollow cylindrical housing 1 holds a shaft 2 which is driven by a motor (not shown). The material to be glued is supplied through a chute 3; it may also be supplied via the face wall 4 as shown by the dash-dotted line. Parallel to the rotation axis 5 of shaft 2, at least supported in their end regions by struts 6 and 7, are rods 8 on which there are cross surfaces 9. These are slightly inclined here since shaft 2 is horizontal, to serve as a transport means for the material 10 to be bonded which, due to the centrifugal forces, seen in the cross-section, is moved in a circular ring path along the inside wall 11 of housing 1. To supply the bonding agent to the housing interior, there is a line 12 which discharges into a space 13 from which additional lines 14 emanate in the radial direction. These may have nozzles (not shown) on their free ends. Some of these nozzles terminate in the material to be bonded. Other nozzles are away from the material to be bonded (see FIGS. 1 and 2). In place of these lines and nozzles, there may also be those which extend through the jacket surface of housing 1 as shown in FIG. 2.

When the rods are tubes, they can be used for cooling the material passing through the gluing machine. They must then be connected to shaft 2 in such a way that cooling liquid supplied via shaft 2 passes through tubes 8 and is carried off through shaft 2. In this case, the tube sections 15 extending radially can serve as supports for tubes 8. Hence the struts supporting the tubes 8 are not required. In addition to the supports at the ends of rods or tubes, further supports, struts, etc., 16 can be provided which may carry cooling means to advantage. As evident from FIG. 2, the rods, tubes, etc., 8 with their cross surfaces 9 are inside material 10 to be bonded or already bonded. The bonded material leaves housing 1 via an outlet 17 which is located at the end of housing 1 facing away from chute 3.

If the shaft 2 is driven, the entire material to be bonded or already bonded is influenced by the rods or tubes 8 over the entire length of housing 1. Hence it is not only influenced in the regions in which the spaced mixing tools of known gluing machines are located.

The cross surfaces forming annular disks are slid onto the rods, tubes, etc., 8 in such a way that between two cross surfaces there is a tube section with chamfered ends. This section holds the cross surfaces in their inclined position. The tube sections can be fixed relative to the rods, tubes, etc. The cross surfaces located at the outer ends of the rods, tubes, etc. may be secured against sliding by end tube sections. Of course, it is also possible to fix the cross surfaces without such tube sections on the rods, tubes, etc., for example, by welding even though a detachable fastening of these cross surfaces is more expedient. If the rods 8 are tubes, they are bent on one of their ends at right angles, and the bent ends are connected with the shaft 2. After sliding on and fixing the cross surfaces 9, the tubes 8 must also be connected to the shaft 2 via detachable tube sections in order to permit flow of cooling means. How the cooling means is conducted is secondary. Since in the embodiment shown, one of the ends of the rods or tubes 8 are in the region of chute 3, special break-up tools for the material to be bonded can be omitted.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

I claim:

1. A gluing machine for gluing lignocellulose-containing particles such as fibers, shavings, dust, and the like, for the production of pressed wood plates, comprising: a housing having on one end an intake for material to be glued, said housing having another end with an outlet for glued material; stirring means having mixing tools and being rotatable with a shaft, said stirring means being centered in said housing; said stirring means having also glue supply nozzles; said mixing tools comprising rods extending parallel to said shaft, said rods being supported on their ends on said shaft; said rods carrying spaced cross surfaces and being relatively close to an interior wall of said housing; at least some of the cross surfaces being inclined to the longitudinal axes of said rods.

2. A gluing machine as defined in claim 1 wherein said shaft is inclined from the horizontal in a direction downward towards said outlet.

3. A gluing machine as defined in claim 2 wherein said shaft comprises at least partially a hollow shaft for conducting a cooling agent, said tubular members having interior spaces connected to said shaft to form with said shaft conduits for conducting said cooling agent.

4. A gluing machine as defined in claim 1 wherein said shaft extends substantially in horizontal direction.

5. A gluing machine as defined in claim 1 wherein said rods comprise substantially tubular members.

6. A gluing machine as defined in claim 1 wherein said cross surfaces comprise annular disks.

7. A gluing machine as defined in claim 6 wherein adjacent annular disks are held inclined and are spaced by tube sections having chamfered ends.

8. A gluing machine as defined in claim 1 wherein said shaft is inclined from the horizontal in a direction downward towards said outlet; said rods comprising tubular members; said shaft being at least partially a hollow shaft for conducting a cooling agent; said tubular members having interior spaces connected to said shaft to form conduits for conducting said cooling agent; said cross surfaces being annular disks held inclined and spaced by tube sections have chamfered ends.

* * * * *